US007530479B2

(12) United States Patent
Bühlmann et al.

(10) Patent No.: US 7,530,479 B2
(45) Date of Patent: May 12, 2009

(54) DEVICE FOR ACTUATING A SLIDING CLOSURE APPLIED TO A VESSEL CONTAINING A MOLTEN METAL

(75) Inventors: Roland Bühlmann, Oberkirch (CH); Rene Christen, Greppen (CH); Philipp Achermann, Root (CH)

(73) Assignee: Stopinc Aktiengesellschaft, Hunenberg (CH)

( * ) Notice: Subject to any disclaimer, the term of this patent is extended or adjusted under 35 U.S.C. 154(b) by 409 days.

(21) Appl. No.: 10/579,013

(22) PCT Filed: Nov. 20, 2004

(86) PCT No.: PCT/EP2004/013200

§ 371 (c)(1),
(2), (4) Date: May 9, 2006

(87) PCT Pub. No.: WO2005/051574

PCT Pub. Date: Jun. 9, 2005

(65) Prior Publication Data

US 2007/0051756 A1 Mar. 8, 2007

(51) Int. Cl.
*B22D 41/50* (2006.01)

(52) U.S. Cl. ..... 222/600; 222/597

(58) Field of Classification Search ..... 222/600, 222/597

See application file for complete search history.

(56) References Cited

U.S. PATENT DOCUMENTS

| | | | | |
|---|---|---|---|---|
| 4,042,207 | A * | 8/1977 | Nehrlich et al. | 222/600 |
| 4,596,345 | A | 6/1986 | Beckers | |
| 6,045,015 | A | 4/2000 | Waltenspuhl et al. | |

FOREIGN PATENT DOCUMENTS

| | | | |
|---|---|---|---|
| BE | 1000392 | A4 | 11/1988 |
| DE | 2603003 | A1 | 7/1976 |
| DE | 3233600 | A | 5/1983 |
| EP | 0 875 320 | A | 11/1998 |
| JP | 08 281417 | A | 2/1997 |

* cited by examiner

*Primary Examiner*—Scott Kastler
(74) *Attorney, Agent, or Firm*—Frishauf, Holtz, Goodman & Chick, P.C.; Robert P. Michal

(57) ABSTRACT

The invention relates to a device for actuating a sliding closure (3) applied to a vessel (1) containing a molten metal, once the vessel (1) has been positioned on a ladle rotating tower. A piston/cylinder unit (10) that can be introduced into a holding element (4) of the sliding closure (3) comprises a drive shaft (11) that can be coupled to a slide rod of the sliding closure. Said piston/cylinder unit (10) can be introduced into the holding element (4) and withdrawn from the same by means of a controllable manipulator (20) arranged on the ladle rotating tower. In this way, the piston/cylinder unit can be applied to the sliding closure effortlessly and precisely in few steps.

13 Claims, 3 Drawing Sheets

DEVICE FOR ACTUATING A SLIDING CLOSURE APPLIED TO A VESSEL CONTAINING A MOLTEN METAL

This application is a U.S. National Phase Application under 35 Usc 371 of International Application PCT/EP2004/013200 filed Nov. 20, 2004.

The invention concerns a device for actuating a sliding closure applied to a vessel containing molten metal according to the main description of Claim 1.

A device of this kind is for example known from EP-A-O 875 320. It comprises a piston/cylinder unit incorporating a drive shaft that can be coupled to a slide rod of the sliding closure, i.e. its sliding unit. The piston/cylinder unit with which the sliding closure can be opened and closed again is mounted on the sliding closure following the positioning of the vessel containing the molten metal on a ladle rotating tower, and removed again from the sliding closure following the emptying of the vessel, so that the vessel can once more be removed from the ladle rotating tower to a location where the same is once more filled with molten metal. The mounting and removing is carried out in such a way that the piston/cylinder unit is introduced from the side into a holding element affixed to the sliding closure transverse to the displacement direction of the sliding unit, i.e. pushed out of the holding element. The introducing and removing of this relatively heavy piston/cylinder unit is carried out manually, and is therefore somewhat cumbersome.

It is the purpose of this invention to create a device of the kind described above that enables an effortless introducing and removing of the piston/cylinder that can be coupled to the sliding unit of the sliding closure into the holding element of the sliding closure.

The fact that the piston/cylinder unit of the invention can be introduced into, i.e., removed from the holding element by means of a controllable manipulator affixed to the ladle rotating tower means that the affixing of the piston/cylinder unit to the sliding closure (and therefore also the actual actuating of the sliding closure) can be carried out effortlessly and precisely with very few steps. The removing of the same is just as easy. In addition the piston/cylinder unit removed from the sliding closure can just as easily be brought into a so-called parking position on the ladle rotating tower, where the same can be optimally protected against any damage caused by outside influence during the exchange of vessels.

The invention will now be described with reference to the drawings, whereby:

Figure 1:
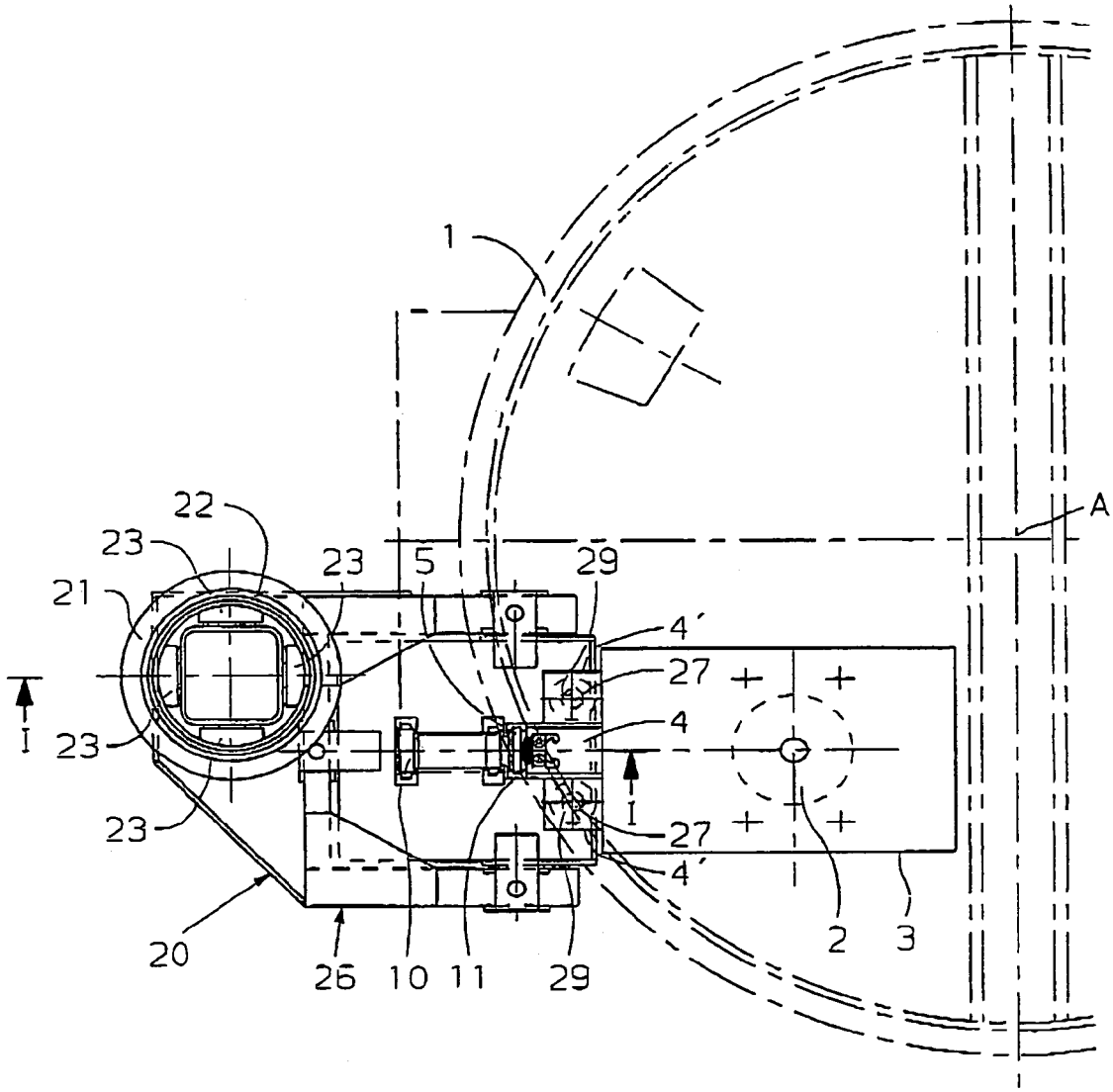
FIG. 1 shows a schematic overview of the position of a sliding closure of a vessel for molten metal positioned in a ladle rotating tower as well as a device for actuating this sliding closure.

FIG. 1 shows a vessel, namely a so-called ladle 1, for molten metal positioned in a ladle rotating tower with a vertical axis A by means of the broken lines, the same comprising a lower outlet 2. On the outlet 2 a sliding closure 3 is located, the design and functionality of which in itself is known and for example described in EP-A-O 875 320, which therefore does not need to be illustrated and described in detail here. By pushing a sliding unit with a fireproof sliding plate contained within the same the outlet 2 can be brought from an open position into a throttled or closed position (and vice versa).

The ladle 1 filled with molten metal is positioned into the ladle rotating tower by means of a crane whilst the sliding closure 3 is closed. To empty the ladle 1 the sliding closure 3 must be opened. For this purpose a piston/cylinder unit 10 that can be coupled to the sliding unit of the sliding closure 3 is envisaged. Unlike the sliding closure 3 the piston/cylinder unit 10 is not mounted on the ladle 1, but remains in the injection moulding unit comprising the ladle rotating tower. It must therefore be mounted on the sliding closure 3 of the ladle 1 positioned in the ladle rotating tower and must be removed from the sliding closure 3 following the emptying of the ladle 1, so that the ladle 1 can be transported by the crane away from the ladle rotating tower to a location where the same can once again be filled with molten metal. The mounting and removing is carried out in such a way that the piston/cylinder unit 10 is introduced into, i.e. pushed out of the holding element 4 transverse to the displacement direction of the sliding unit by means of guiding elements described below into a holding element 4 affixed to the sliding closure 3. Following the introduction a drive shaft 11 of the piston/cylinder unit 10 is coupled to a slide rod of the sliding unit in coaxial alignment to the same. The way in which this is carried out as well as various embodiments of couplings envisaged for this are described in EP-A-O 875 320 mentioned above and are therefore not illustrated and described in detail here.

Figure 2:
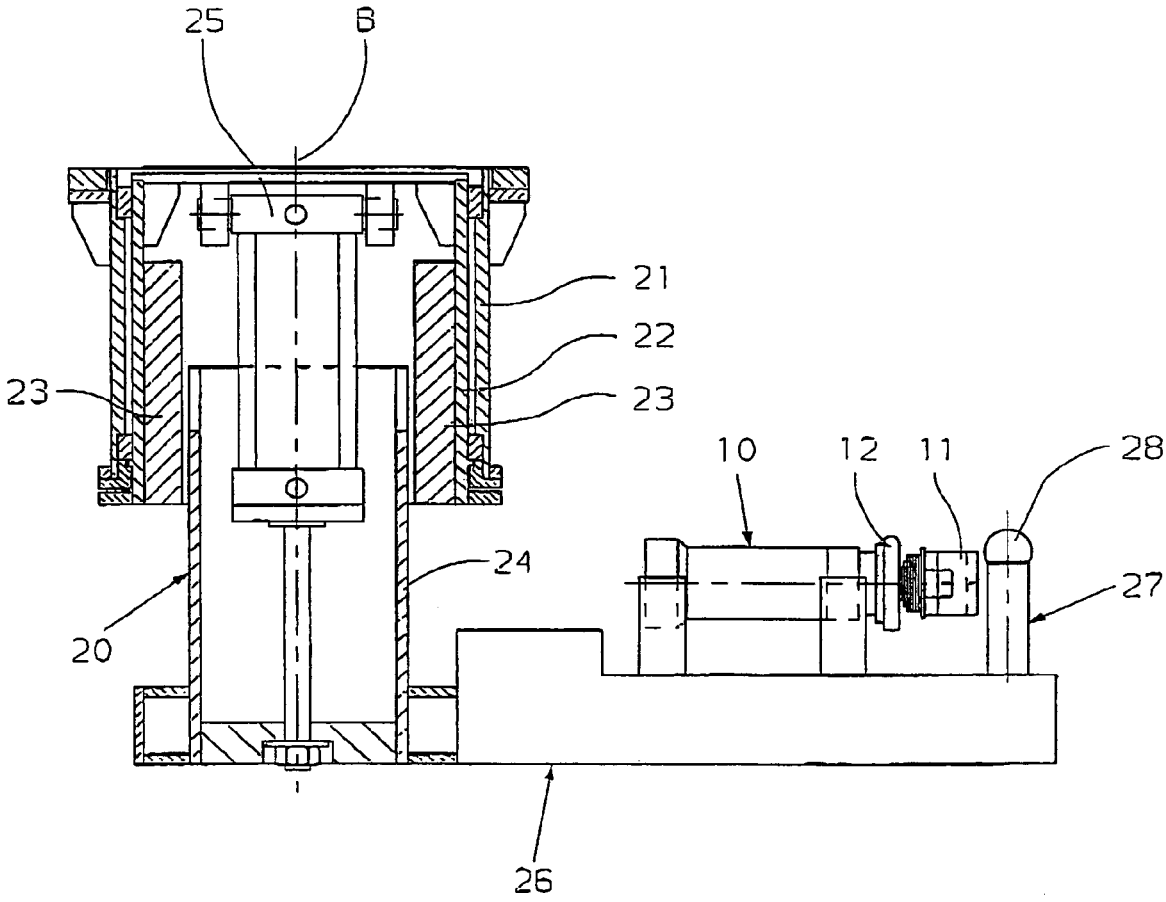
FIG. 2 shows a side view of the device for actuating the sliding closure shown in FIG. 1 in the form of a partial cross-section.

According to the invention the introducing, i.e. pushing of the piston/cylinder unit 10 into/out of the holding element 4 is achieved by means of a manipulator 20 located on the ladle rotating tower. The manipulator 20 can be seen on the rotating housing 21 affixed to the ladle rotating tower shown in FIGS. 1 and 2, which can be tilted around a vertical axis B; the rotatably affixed part of a manipulator 20 has been allocated the reference number 22 in FIGS. 1 and 2. The interior of this rotating part. 22 is equipped with vertical guides 23 for a lifting part 24 that can be vertically adjusted in relation to the rotating part 22, the adjustment of which is achieved by a piston/cylinder unit 25 aligned in the direction of the axis B. On the lower end of the lifting part 24 a lifting frame 26 extending transverse to the B axis, i.e. horizontally, is located, the upper surface of which is equipped with the piston/cylinder unit 10 envisaged for actuating the sliding closure 3.

The manipulator 20 can be tilted backwards and forwards by preferably 90° between two positions. In a starting position which is not illustrated in the drawing, which is also called parking position, the entire manipulator 20, i.e. even the lifting frame 26 with the piston/cylinder unit 10, is located outside of the area of the ladle rotating tower envisaged for the ladle 1, namely below a rotating tower frame used for introducing the ladle 1. In this way the manipulator 20 as well as the piston/cylinder unit 10 are optimally protected against any damage caused by outside influences during the introducing of the ladle 1.

Following the introducing of the ladle 1 the manipulator 20 is tilted into the other working position shown in FIG. 1, in which the lifting frame 26 projects under the introduced ladle 1 and the piston/cylinder unit 10 is as much as possible aligned in the displacement direction of the sliding closure affixed to the ladle 1. In this working position the piston/cylinder unit 10 can now be pushed into the holding element 4 with a U-shaped cross-section open at the bottom by lifting the manipulator lifting part 24, i.e. the lifting frame 26 from the bottom with a guide element 12 (FIG. 2) envisaged for this purpose into a relevant guiding groove 5 (FIG. 1).T*he* guide element 12 is located at the front, sliding closure side cylinder end and radially projects from the same. To ensure that the guide element 12 can be safely introduced into the guide groove 5 of the holding element 4 the manipulator 20 as well as the sliding closure 3, i.e. the holding element 4, are equipped with positioning means which take the form of two vertically and upwardly aligned positioning bolts 27 affixed to the lifting frame 26 and set in front of the piston/cylinder unit 10 in the direction of the sliding closure 3 in the embodiment illustrated here, which can be pushed into one each of vertically aligned recesses 29 of a holding element 4' affixed to the sliding closure 3 open at the bottom (see also FIGS. 3 and 4). The positioning bolts 27 are each equipped with a ball head 28 at their free ends.

Figure 3:
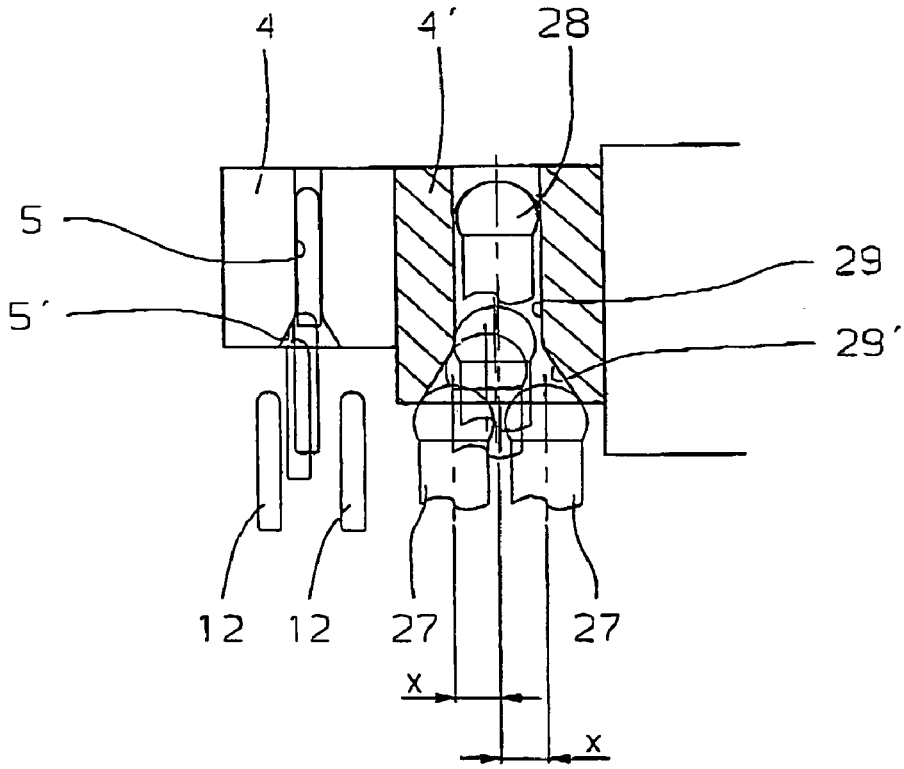
FIGS. 3 and 4 schematically show means for positioning the device for actuating the sliding closure in relation to a holding element affixed to the sliding closure.
Figure 4:
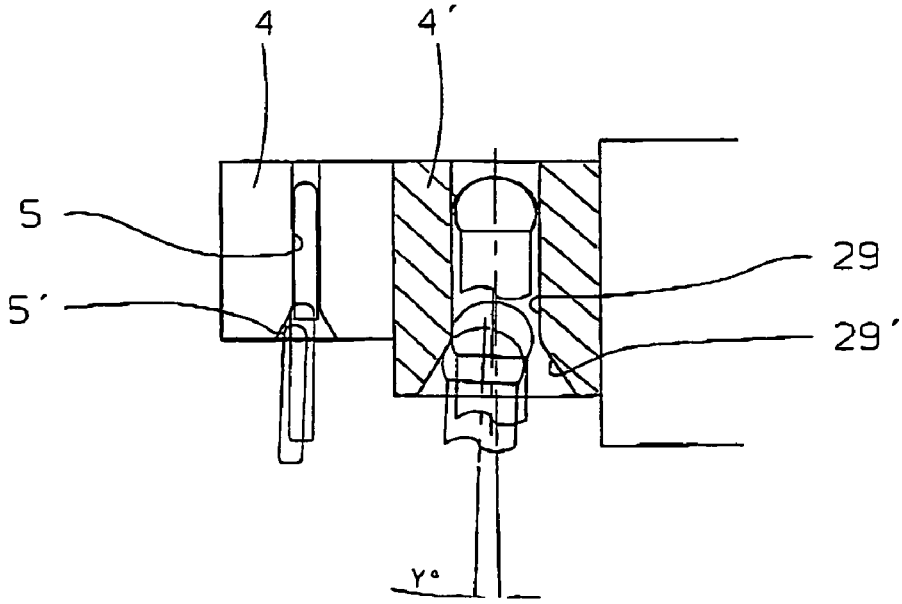

The recesses 29 comprise a funnel-shaped insertion part 29' that is wider at the bottom (FIGS. 3 and 4). The guide groove 5 also is equipped with a correspondingly widening insertion part 5'. The insertion parts 29' of the holding elements, i.e. holding parts 4' for the positioning bolts 27, i.e. their ball heads 28 are lower than the insertion part 5' for the guide element 12. In addition the ball heads 28 project further upwards than the guide element 12 of the piston/cylinder unit 10. This results in the positioning bolts 27 located at both sides of the piston/cylinder unit 10 being inserted first into the funnel-shaped insertion parts 29' with their ball heads 28 during the lifting of the lifting frame 26, and being centered there, so that any inaccuracies in the relative positioning of the manipulator 20 in relation to the sliding closure 3 are compensated for, and the guide element 12 accurately spaced apart from the positioning bolts 27 is safely inserted into the guide groove 5, which is in turn accurately spaced apart from the recesses 29. In this way inaccuracies, i.e. offsets along a horizontal plane (see FIG. 3) as well as angle inaccuracies between the sliding plane and the lifting frame plane of the manipulator 20 (see FIG. 4) can be corrected.

The manipulator 20, especially a preferably hydraulic rotating drive as well as a hydraulic lifting drive of the same, is controlled by means of a controller not shown in detail here. For normal operation (as opposed to emergency, i.e. maintenance operation) remote control is envisaged. The control box is located in a control room with visual access to the ladle that is to be poured. The drives can be hydraulically deactivated via a by-pass on the manipulator and mechanically de-coupled and moved in a freewheeling position.

The fact that according to the invention the piston/cylinder unit 10 can be introduced into the holding element 4, i.e. pushed out of the holding element 4 by means of a controllable manipulator 20 located on the ladle rotating tower means that the affixing of the piston/cylinder unit to the sliding closure 3 (and therefore the actual actuating of the sliding closure 3) can be carried out effortlessly and precisely with very few steps. Removing the same is just as simple. In addition the piston/cylinder unit 10 removed from the sliding closure 3 can be brought into a so-called parking position on the ladle rotating tower just as easily, where the same can be optimally protected against any damage caused by outside influence during the changeover of vessels.

The manipulator can of course also be of a different design, for example similar to a robot, where the piston/cylinder unit 10 is introduced into the holding element 4, i.e. removed from the same by means of a robot arm. However, a means for positioning the robot am on the holding element must once again be envisaged here as well. This could be similar to the embodiment described above and take the form of positioning bolts 27 and corresponding recesses 29, or consist of other electronic means such as for example a laser.

The invention claimed is:

1. A device for actuating a sliding closure applied to a vessel containing molten metal once the vessel has been positioned on a ladle rotating tower, with a piston/cylinder unit that can be introduced into a holding element of the sliding closure, comprising a drive shaft that can be coupled to a slide rod of the sliding closure, wherein the piston/cylinder unit can be introduced into the holding element and withdrawn from the same by means of a controllable manipulator, wherein the piston/cylinder unit is arranged on a lifting frame of the manipulator affixed to the ladle rotating tower and can be introduced into a guide groove of the holding element transversely in a vertical direction in relation to the displacement direction of the sliding closure by adjusting the same with a guide element, wherein the device further comprises means for positioning the lifting frame in relation to the holding element during the adjusting of the same and nor to introducing the guide element into the guide groove, and wherein the piston/cylinder unit is affixed to a vertically adjustable lifting frame of the manipulator and can be introduced into a holding element open at the bottom and equipped with the guide groove with its guide element.

2. The device according to claim 1, wherein the lifting frame is affixed to a lifting part that can be vertically adjusted in relation to a rotating part of the manipulator, whereby the rotating part is tiltably positioned around a vertical axis within a rotating housing affixed to the ladle rotating tower.

3. The device according to claim 2, wherein the rotating part with the lifting part equipped with the lifting frame guided within the same can be tilted between a parking position and a working position, whereby the piston/cylinder unit can be introduced into the holding element.

4. The device according to Claim 3, wherein the rotating part can be tilted by almost 90° between the parking position and the working position.

5. The device according to claim 1, wherein the means for positioning the lifting frame are formed by two positioning bolts affixed to the holding frame and aligned in an upward direction in relation to the holding element, which can each be introduced into a vertical recess open at the bottom of a non-displaceable holding element during the lifting frame adjustment with their free ends.

6. The device according to claim 5, wherein the positioning bolts comprise ball heads at their free ends, and can be centered together with these within funnel-shaped introduction part of the recesses that widen at the bottom.

7. The device according to claim 5, wherein the positioning bolts of the piston/cylinder unit can be offset in the direction of the sliding closure and located at both sides of the same.

8. The device according to claim 1, wherein the piston/cylinder unit is affixed to a vertically adjustable lifting frame of the manipulator and can be introduced into a holding element open at the bottom and equipped with the guide groove with its guide element.

9. The device according to claim 1, wherein the means for positioning the lifting frame are formed by two positioning bolts affixed to the holding frame and aligned in an upward direction in relation to the holding element, which can each be introduced into a vertical recess open at the bottom of a non-displaceable holding element during the lifting frame adjustment with their free ends.

10. The device according to claim 2, wherein the means for positioning the lifting frame are formed by two positioning bolts affixed to the holding frame and aligned in an upward direction in relation to the holding element, which can each be introduced into a vertical recess open at the bottom of a non-displaceable holding element during the lifting frame adjustment with their free ends.

11. The device according to Claim 3, wherein the means for positioning the lifting frame are formed by two positioning bolts affixed to the holding frame and aligned in an upward direction in relation to the holding element, which can each be introduced into a vertical recess open at the bottom of a non-displaceable holding element during the lifting frame adjustment with their free ends.

12. The device according to claim 4, wherein the means for positioning the lifting frame are formed by two positioning bolts affixed to the holding frame and aligned in an upward direction in relation to the holding element, which can each be introduced into a vertical recess open at the bottom of a non-displaceable holding element during the lifting frame adjustment with their free ends.

13. The device according to claim 6, wherein the positioning bolts of the piston/cylinder unit can be offset in the direction of the sliding closure and located at both sides of the same.

* * * * *